US005392923A

United States Patent [19]

Hassard et al.

[11] Patent Number: 5,392,923

[45] Date of Patent: Feb. 28, 1995

[54] DIVERSE MULTIPLE ARTICLE ORGANIZING APPARATUS

[76] Inventors: Geoffrey J. Hassard; Irene G. Hassard, both of 74 Pleasant St., Stoneham, Mass. 02180

[21] Appl. No.: 75,899

[22] Filed: Jun. 11, 1993

[51] Int. Cl.[6] ..... A47F 7/00

[52] U.S. Cl. ..... 211/13; 211/162; 211/153; 211/51; 108/96

[58] Field of Search ..... 211/13, 59.4, 188, 153, 211/187, 71, 51, 128, 77, 52, 70.7, 162; 248/507; 108/106, 107, 55.1, 55.5, 96

[56] References Cited

U.S. PATENT DOCUMENTS

| | | | |
|---|---|---|---|
| 450,419 | 4/1891 | McIhhenny | 211/71 |
| 844,071 | 2/1907 | Weston | 211/188 X |
| 2,187,355 | 1/1940 | MacManus | 211/71 X |
| 2,443,684 | 6/1948 | Lazarus | 211/188 X |
| 2,454,516 | 11/1948 | Laureyns | 211/41 |
| 2,891,676 | 6/1959 | Miller | 211/41 |
| 2,934,210 | 4/1960 | Jordan | 211/41 |
| 2,967,622 | 1/1961 | Poglein et al. | 211/41 |
| 3,115,253 | 12/1963 | Malbin et al. | 211/188 X |
| 3,529,742 | 9/1970 | Cumming | 211/70.7 X |
| 4,018,340 | 4/1977 | Gold | 211/187 |
| 4,501,369 | 2/1985 | Fox | 211/187 X |
| 4,955,485 | 9/1990 | Alton | 211/188 X |
| 5,143,229 | 9/1992 | La Corte | 211/71 |
| 5,148,928 | 9/1992 | Arnold | 211/153 X |
| 5,188,244 | 2/1993 | Hollstegge | 211/71 |

*Primary Examiner*—Ramon O. Ramirez
*Assistant Examiner*—Korie H. Chan
*Attorney, Agent, or Firm*—John R. Flanagan

[57] ABSTRACT

A multiple article organizing apparatus includes a circular base for resting on a support surface, a plurality of pairs of elongated support poles, and one or more circular shelves secured to the pairs of support poles. One of the pairs of poles is secured upright on the base. Another of the pairs of poles is secured upright on one of the shelves and spaced above the base such that the shelves are spaced above the base by the pairs of poles and vertically spaced from one another. The organizing apparatus also includes a plurality of hold-down rails slidably mounted to the support poles between the base and one shelf and between the shelves for undergoing sliding movement vertically along the respective pairs of poles toward and away from the respective base and shelves and any articles resting thereon for releasably retaining the articles thereon.

18 Claims, 1 Drawing Sheet

DIVERSE MULTIPLE ARTICLE ORGANIZING APPARATUS

BACKGROUND OF THE INVENTION

1. Field of the Invention

The present invention generally relates to storage of articles and, more particularly, is concerned with an apparatus for organizing diverse multiple articles.

2. Description of the Prior Art

At cookouts and similar gatherings, the host and hostess typically provide the necessary table setting paraphenelia, such as dinner plates, napkins, drinking cups and utensils, for the persons in attendance at the gathering to help themselves. However, these articles of the table setting paraphenelia must be secured in some manner so as not to blow away should a strong wind gust arise.

One way to overcome this problem is to store the articles in a large box or container from which they are removed at the time of use. However, use such of a box is clumsy and also highly undesirable from an aesthetic standpoint and thus is not a workable solution to the problem.

Another way to overcome this problem is to place the articles on a storage rack. Some representative examples of storage racks found in the prior patent art are the ones discloses in U.S. Pat. Nos. to Laureyns (2,454,516), Miller (2,891,676), Jordan (2,934,210) and Poglein et al (2,967,622). These prior art racks only address the storage of either plates alone or with some utensils or the storage of cups, saucers and dishes. Thus, these racks do not accommodate all of the articles of table setting paraphenelia used at cookouts and so do not appear to be an adequate solution to the problem.

Consequently, a need still exists for a suitable apparatus to organize diverse multiple articles and particularly articles of table setting paraphenelia.

SUMMARY OF THE INVENTION

The present invention provides a diverse multiple article organizing apparatus designed to satisfy the aforementioned need. The article organizing apparatus of the present invention is particularly suited, although not limited, to organizing articles, such as table setting paraphenelia, namely, dinner plates, napkins, drinking cups and utensils. The article organizing apparatus permits easy and convenient removal of the articles for use, while securely retaining the articles against the effects of wind gusts during periods of non-use.

Accordingly, the present invention is directed to a diverse article organizing apparatus which comprises: (a) a bottom base for resting on a support surface; (b) a pair of elongated lower support poles secured upright on said bottom base; (c) a pair of elongated upper support poles; (d) a pair of lower and upper vertically-spaced shelves secured to the pair of upper support poles; (e) means secured on upper ends of the lower support poles and supporting the upper support poles above the lower support poles; and (f) a plurality of hold-down rails slidably mounted to the respective pairs of lower and upper support poles and being disposed respectively above the bottom base, lower shelf and upper shelf.

The article organizing apparatus of the present invention also includes a plurality of utensil holders standing upright and attached on a top support member secured to upper ends of the upper support poles. The holders are adapted to hold different utensils. Also, a drinking cup holder in the form of an elongated peg is mounted in an upright position on the bottom base to one side of the pair of lower support poles.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
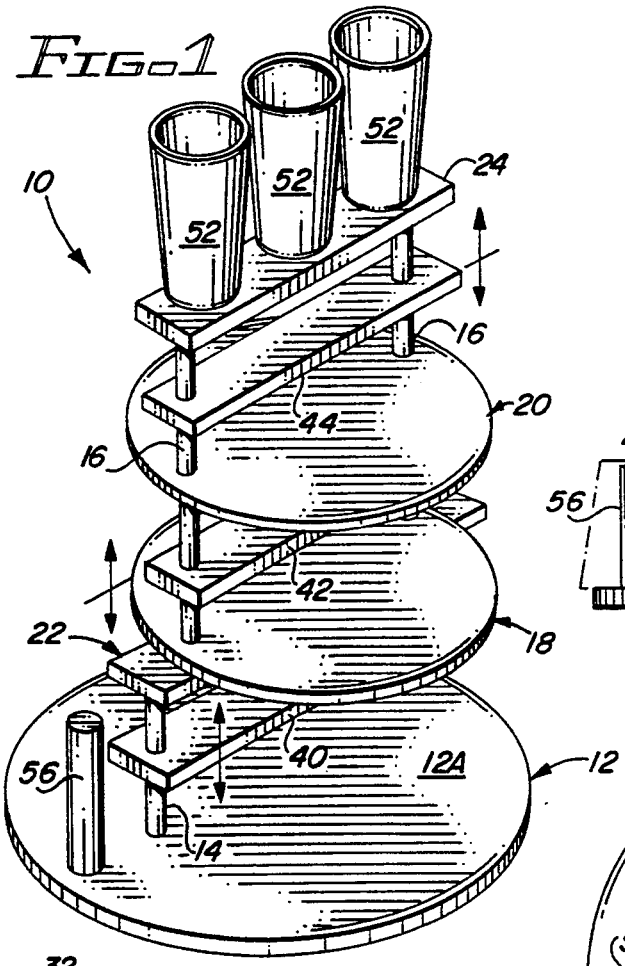
FIG. 1 is a perspective view of a diverse multiple article organizing apparatus of the present invention.
Figure 2:
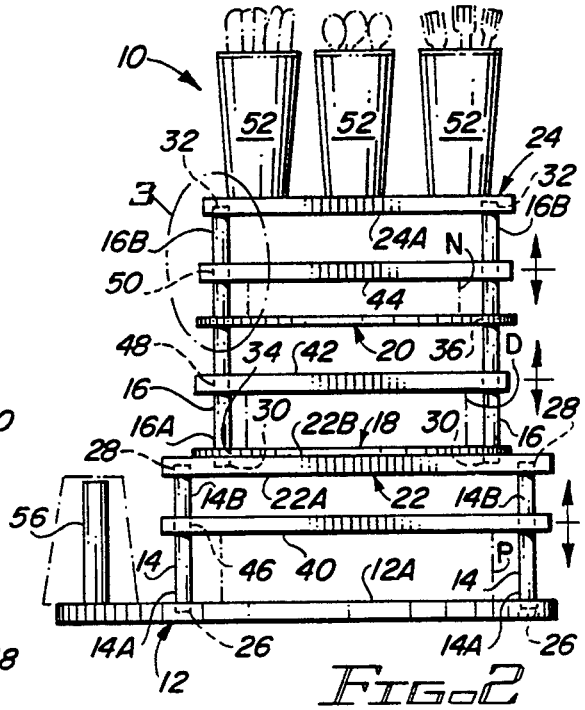
FIG. 2 is a front elevational view of the article organizing apparatus shown in FIG. 1.
Figure 3:
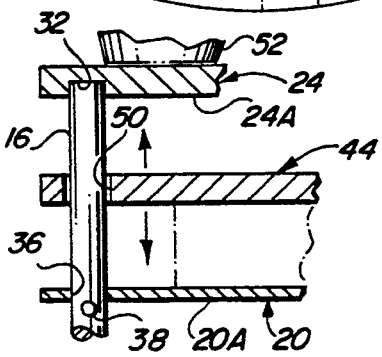
FIG. 3 is an enlarged detailed view, partly in section, of the portion of the article organizing apparatus encompassed by the oval 3 shown in FIG. 2.
Figure 4:
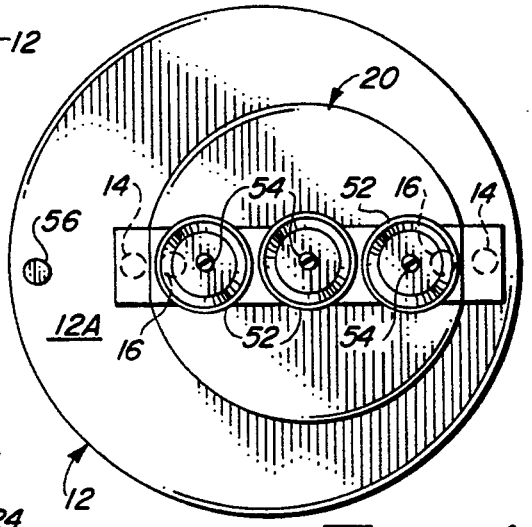
FIG. 4 is a top plan view of the article organizing apparatus shown in FIG. 1.

Referring to the drawings and particularly to FIGS. 1 to 3, there is illustrated a diverse multiple article organizing apparatus of the present invention, being generally designated 10. Basically, the article organizing apparatus 10 includes a bottom base 12 for resting on a support surface (not shown), pairs of elongated lower and upper support stiles or poles 14, 16, lower and upper shelves 18, 20 secured to the pairs of lower and upper support poles 14, 16, an intermediate support member 22, and a top support member 24.

The lower support poles 14 are secured upright on the bottom base 12 and extend between the bottom base 12 and the intermediate support member 22. The upper support poles 16 are secured upright on the intermediate support member 22 and extend through the lower shelf 18 and between the intermediate support member 22 and the top support member 24. Thus, the upper support poles 16 are spaced above the bottom base 12 such that the lower and upper shelves 18, 20 are spaced above the bottom base 12 by the pairs of lower and upper support poles 14, 16 and also are vertically spaced from one another. The top support member 24 is secured on the upper ends of the upper support poles 16.

More particularly, the bottom base 12 is preferably a circular plate which provides good stability against tipping of the apparatus 10. However, other shapes besides circular are of course possible. The bottom base 12 has a pair of laterally spaced-apart countersunk holes 26 recessed therein from a top surface 12A thereof. The intermediate support member 22 preferably is a substantially flat rectangular board, although other shapes are possible also. The intermediate support member 22 has a pair of laterally spaced-apart countersunk holes 28 recessed therein from a bottom surface 22A thereof. The opposite lower and upper ends 14A, 14B of the lower support poles 14 are seated respectively in the holes 26, 28 and are attached to the bottom base 12 and intermediate support member 22 in any suitable manner, such as by screws (not shown) and by adhesive. The bottom base 12 and intermediate support member 22 can be fabricated from any suitable material, such as a wood or plastic.

As readily apparent in FIG. 2, the upper support poles 16 are preferably longer in length than the lower support poles 14. The lower and upper support poles 14, 16 can be in the form of dowel stock and fabricated from any suitable material, such as wood or plastic. The intermediate support member 22 also has a pair of laterally spaced-apart countersunk holes 30 recessed therein from the top surface 22B thereof. The top support member 24 has a pair of laterally spaced-apart countersunk holes 32 recessed thereon from a bottom surface 24A thereof. The opposite lower and upper ends 16A, 16B of the upper support poles 16 are seated respectively in the holes 30, 32 and are attached to the intermediate and top support members 22, 24 in any suitable manner, such as by screws (not shown) and by adhesive.

The lower and upper shelves 18, 20 are preferably circular plates having substantially the same diameters, but smaller in diameter than the bottom base 12. It should be apparent that other shapes and other diameters are also possible. The lower and upper shelves 18, 20 have respective pairs of laterally spaced-apart openings 34, 36 defined therethrough. The upper support poles 16 pass through the respective pairs of openings 34, 36 in the lower and upper shelves 18, 20. The bottom shelf 18 is secured upon a top surface 22B of the intermediate support member 22 in any suitable manner, such as by screws (not shown) and adhesive. The lower and upper shelves 18, 20 can be fabricated from any suitable material, such as wood or plastic. The upper shelf 20 is secured and supported on the upper support poles 16 approximately midway between the lower shelf 18 and top support member 24 by a pair of pins 38 installed transversely through the upper support poles 16 and along a bottom surface 20A of the upper shelf 20. The lower and upper shelves 18, 20 can be fabricated from any suitable material, such as a wood or plastic.

The article organizing apparatus 10 also includes a plurality of lower, middle and upper hold-down rails 40, 42, 44 slidably mounted to the respective pairs of lower and upper support poles 14, 16. All of the rails 40, 42, 44 preferably are substantially flat rectangular boards, although other shapes are possible also. The lower rail 40 is longer than the middle and upper rails 42, 44, as the spacing between the lower support poles 18 is greater than that between the upper support poles 20. The lower, middle and upper rails 40, 42, 44 have pairs of laterally spaced-apart apertures 46, 48, 50 defined therethrough, respectively permitting passage of the corresponding lower and upper support poles 18, 20. The lower, middle and upper rails 40, 42, 44 can be fabricated from any suitable material, such as a wood or plastic.

Figure 5:
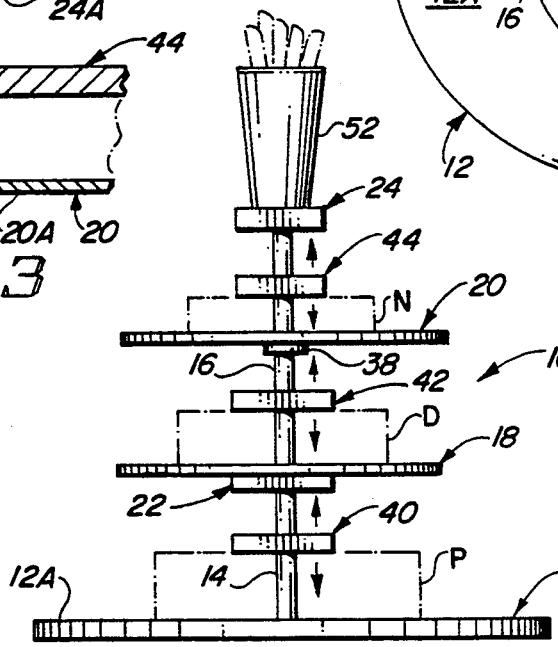
FIG. 5 is a side elevational view of the article organizing apparatus as seen along line 5—5 of FIG. 2.

More particularly, the lower hold-down rail 40 is located between the base 12 and the lower shelf 18 and is mounted to the lower support poles 14 so as to be capable of undergoing rectilinear sliding movement therealong toward and away from the base 12 and the lower shelf 18. Such sliding movement moves the lower hold-down rail 40 toward and away from any articles, such as paper plates P being shown in phantom outline in FIGS. 2 and 5, resting on the base 12. The lower hold-down rail 40 has sufficient weight to retain the articles P on the base 12 until the lower rail 40 is lifted through a sufficient distance to release the articles P and permit one or more to be withdrawn from the stack.

The middle hold-down rail 42 is located between the lower shelf 18 and upper shelf 20 and is mounted to the upper support poles 16 so as to be capable of undergoing rectilinear sliding movement therealong toward and away from the respective lower and upper shelves 18, 20. Such sliding movement moves the middle hold-down rail 42 toward and away from any articles, such as dishes D of smaller size being shown in phantom outline in FIGS. 2 and 5, resting on the lower shelf 18. The middle hold-down rail 42 has sufficient weight to retain the articles D on the lower shelf 18 until the middle rail 42 is lifted through a sufficient distance to release the articles D and permit one or more to be withdrawn from the stack.

The upper hold-down rail 44 is located between the upper shelf 20 and the top support member 24 and is mounted to the upper support poles 16 so as to be capable of undergoing rectilinear sliding movement therealong toward and away from the upper shelf 20 and top support member 24. Such sliding movement moves the upper hold-down rail 44 toward and away from any articles, such as napkins N being shown in phantom outline in FIGS. 2 and 5, resting on the upper shelf 20. The upper hold-down rail 44 has sufficient weight to retain the articles N on the upper shelf 20 until the upper rail 44 is lifted through a sufficient distance to release the articles N and permit one or more to be withdrawn from the stack.

The article organizing apparatus 10 further includes a plurality of utensil holders 52 standing upright and attached on the top surface 24A of the top support member by any suitable means, such as screws 54. Different holders 52 are adapted to hold the different utensils, such as pluralities of forks, knives and spoons, used at cookouts. The holders 52 preferably can be conventional 12 oz. plastic tumblers, although other types of receptacles can be used. Also, a drinking cup holder 56 is provided on the bottom base 12. The holder 56 preferably in the form of an elongated peg, such as a cylindrical dowel fabricated from wood or plastic, is seated at its lower end in a recess 58 formed in the top surface 12A of the bottom base 12 located outwardly from the left one of the holes 26. The holder 56 is retained in the upright position by being attached to the bottom base 12 by any suitable means, such as a screw and an adhesive.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

We claim:

1. A multiple article organizing apparatus, comprising:

(a) a bottom base for resting on a support surface;

(b) a pair of elongated lower support poles secured upright on said bottom base;

(c) a pair of elongated upper support poles;

(d) a pair of lower and upper vertically-spaced shelves secured to said pair of upper support poles;

(e) means secured on upper ends of said lower support poles for supporting said upper support poles and said pair of lower and upper shelves therewith above said lower support poles;

(f) a releasable lower hold-down rail with means slidably mounting said lower hold-down rail to said pair of lower support poles, said lower hold-down rail being disposed between said bottom base and said upper means and adapted to overlie said bottom base and articles resting thereon, said lower hold-down rail being slidably movable in non-rotatable rectilinear fashion along said pair of lower support poles toward and away from said bottom base and said upper means and toward and away from articles resting on said bottom base so as to permit resting of said lower hold-down rail upon the articles with sufficient weight to retain the articles on said bottom base and alternatively to permit lifting of said lower hold-down rail through a sufficient distance upwardly away from the articles and toward said upper means to release and permit removal of the articles from said bottom base; and (g) a releasable upper hold-down rail with means slidably mounting said upper hold-down rail to said pair of upper support poles, said upper hold-down rail being disposed between said lower shelf and said upper shelf and adapted to overlie said lower shelf and articles resting thereon, said upper hold-down rail being slidably movable in non-rotatable rectilinear fashion along said pair of upper support poles toward and away from said lower and upper shelves and toward and away from articles resting on said lower shelf so as to permit resting of said upper hold-down rail upon the articles with sufficient weight to retain the article on said lower shelf and alternatively to permit lifting of said upper hold-down rail through a sufficient distance upwardly away from the articles and toward said upper shelf to release and permit removal of the articles from said lower shelf.

2. The apparatus of claim 1 wherein said bottom base is a circular plate.

3. The apparatus of claim 2 wherein said upper means is an intermediate support member having a pair of laterally spaced-apart countersunk holes recessed therein from a bottom surface thereof.

4. The apparatus of claim 3 wherein said bottom base has a pair of laterally spaced-apart countersunk holes recessed therein from a top surface thereof.

5. The apparatus of claim 4 wherein said lower support poles have opposite lower and upper ends seated respectively in said holes of and attached to said bottom base and intermediate support member.

6. The apparatus of claim 1 wherein said upper support poles are longer in length than said lower support poles.

7. The apparatus of claim 1 wherein said upper means is an intermediate support member having a pair of laterally spaced-apart countersunk holes recessed therein from a top surface thereof.

8. The apparatus of claim 7 further comprising:

a top support member has a pair of laterally spaced-apart countersunk holes recessed thereon from a bottom surface thereof.

9. The apparatus of claim 8 wherein said upper support poles have opposite lower and upper ends seated respectively in said holes of and attached to said intermediate support member and said top support member.

10. The apparatus of claim 8 wherein said upper shelf is secured and supported on said upper support poles approximately midway between said lower shelf and said top support member.

11. The apparatus of claim 1 further comprising:

a top support member secured on top ends of said upper support poles; and a plurality of utensil holders standing upright and attached on a top surface of said top support member.

12. The apparatus of claim 1 further comprising:

a drinking cup holder in the form of an elongated peg supported in an upright position on said bottom base.

13. The apparatus of claim 1 wherein said lower and upper shelves are circular plates.

14. The apparatus of claim 12 wherein said lower and upper shelves have substantially the same diameters.

15. The apparatus of claim 13 wherein said bottom base is a circular plate and said upper and lower shelves are smaller in diameter than said bottom base.

16. The apparatus of claim 13 wherein said lower and upper shelves have respective pairs of laterally spaced-apart openings defined therethrough, said upper support poles passing through said respective pairs of openings in said lower and upper shelves.

17. The apparatus of claim 1 wherein said means slidably mounting said lower hold-down rail includes a pair of laterally spaced-apart apertures defined therethrough to permit passage therethrough of said lower support poles such that said lower hold-down rail is adapted to undergo slidable movement therealong.

18. The apparatus of claim 1 wherein said means slidably mounting said upper hold-down rail includes a pair of laterally spaced-apart apertures defined therethrough to permit passage therethrough of said upper support poles such that said upper hold-down rail is adapted to undergo slidable movement therealong.

* * * * *